US005419842A

United States Patent [19]

Crutzen

[11] Patent Number: 5,419,842

[45] Date of Patent: May 30, 1995

[54] ANIONIC FABRIC SOFTENING COMPOSITION CONTAINING PENTAERYTHRITOL SOFTENER

[75] Inventor: André Crutzen, Liege-Sclessin, Belgium

[73] Assignee: Colgate-Palmolive Company, New York, N.Y.

[21] Appl. No.: 258,297

[22] Filed: Jun. 13, 1994

[51] Int. Cl.[6] ..... D06M 13/244; D06M 13/165

[52] U.S. Cl. ..... 252/8.6; 252/8.7; 252/8.9

[58] Field of Search ..... 252/8.6, 8.9, 8.7

[56] References Cited

U.S. PATENT DOCUMENTS 5,332,513 7/1994 Doms et al. ..... 252/8.6

*Primary Examiner*—Mark L. Bell
*Assistant Examiner*—C. M. Bonner
*Attorney, Agent, or Firm*—Bernard Lieberman; Robert C. Sullivan

[57] ABSTRACT

An anionic fabric softening emulsion composition containing a pentaerythritol softener, an anionic emulsifying agent, and, optionally, a nonionic emulsifier.

8 Claims, No Drawings

ANIONIC FABRIC SOFTENING COMPOSITION CONTAINING PENTAERYTHRITOL SOFTENER

FIELD OF THE INVENTION

This invention relates to fabric softening compositions for applications to washed laundry during rinsing and/or drying cycles, to apply to the fibers of the fabrics of such laundry fabric softening amounts of fabric softening components of the compositions. More particularly, it relates to such compositions that include as fabric softening components higher fatty acid esters of pentaerythritol, of pentaerythritol oligomers, or of ethoxylated derivatives thereof, and which do not contain positively charged (i.e., cationic) emulsifiers or softeners (e.g., quaternary ammonium salts.)

DISCUSSION OF THE PRIOR ART

Fabric softening compositions have long been employed to make washed laundry items softer to the touch and more comfortable to the wearer. Such compositions include solutions, emulsions, and particulate and powder products. The fabric softeners of choice for most commercial products have usually been quaternary ammonium salts, such as dimethyl ditallowyl ammonium chloride, and emulsions of such softener have been added to the rinse water in the washing machine to effectively soften laundry. Alternatively, such emulsions or powder products including such fabric softener can be added to the wash water, with a detergent composition or the detergent composition can include a fabric softening component to make a so-called "softergent".

Although various fabric softening (and antistatic) compositions have been commercially marketed, with varying degrees of commercial success, over the years and although various fabric softening components thereof have been included in them the most successful of such components have been the quaternary ammonium salts. Such compounds are of the formula

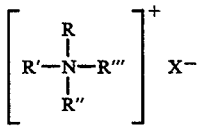

wherein R, R′, R″ and R‴ are all alkyl groups, with at least one of such alkyls being a higher alkyl and with the others being lower alkyl(s) of 1 or 2 carbon atoms, and with $X^-$ being a salt-forming anion. Preferably, such quaternary ammonium salt is a di-lower alkyl, di-higher alkyl ammonium halide but mono-lower alkyl tri-higher alkyl ammonium halides have also found use in some instances.

While such quaternary ammonium salts have been effective fabric softeners in the described applications they are characterized by disadvantageous properties too, which have led to attempts to find replacements for them. For example, being cationic, they tend to react with anionic materials, sometimes to the detriment of their intended fabric softening function. Moreover, they are not as readily biodegradable as is desirable and they have been found to be toxic to aquatic organisms, which could lead to harmful effects on aquatic life in lakes, rivers and other waters into which waste waters carrying such compounds could be emptied.

In efforts to find replacements for quaternary ammonium salts as fabric softeners, neoalkanamides, glyceryl esters, glycol esters, silicones, cationicanionic complexes, bentonite and various lubricants have been suggested for use alone or in conjunction with reduced amounts of the quaternary ammonium salts but frequently the softening effects thereof were insufficient or the replacement softeners possessed other characteristics which made them less desirable than the quaternary ammonium salts, despite the disadvantages thereof.

Now, however, applicants have discovered an anionic composition that can satisfactorily soften laundry and that does not exhibit the adverse effects of the quaternary ammonium salts on aquatic organisms. This is an especially important discovery at this time when the seriousness of the problem is being recognized and when several countries are passing laws and promulgating regulations prohibiting the incorporation of some quaternary ammonium compounds in products that may be discharged into sewage and drainage systems and, ultimately, into bodies of water wherein the possibility of toxic effects on aquatic life exists.

In application Ser. No. 07/755,965 filed Sep. 6, 1991 now abandoned; Ser. No. 07/756,030 filed Sep. 6, 1991 now abandoned; Ser. No. 07/638,945 filed Jan. 9, 1991 allowed as U.S. Pat. No. 5,126,060; and Ser. No. 07/945,715 filed Sep. 16, 1992; the entire contents and disclosures of each of which are incorporated herein by reference, there are described certain higher fatty acid esters of pentaerythritol, pentaerythritol oligomers and ethoxylated derivatives thereof which function as fabric softeners in conjunction with dispersing agents therefor.

U.S. Pat. No. 3,928,212 describes various softening agents which are polyhydric alcohol esters, but none of them is a pentaerythritol ester or an ester of an oligomer or ethoxylated derivative of pentaerythritol.

U.S. Pat. No. 4,126,562 mentions erythritol and pentaerythritol in a list of alcohols which may be reacted with higher fatty acids to produce fabric conditioning agents, but no such compound is actually described and none is shown in a fabric softening composition or article. Also, U.S. Pat. No. 4,126,562 discloses a combination of a quaternary ammonium salt fabric softener and a nonionic ester of an alcohol with a higher fatty acid, and no teaching therein that the ester would be useful alone as a fabric softener.

U.S. Pat. No. 4,142,978 describes sorbitan esters with phase modifying components such as alkyl sulfates on a dryer sheet for softening laundry while it is being tumble-dried in an automatic laundry dryer. There is no mention in this patent of any pentaerythritol esters.

U.S. Pat. No. 4,162,984 relates to a textile treatment emulsion of a water-insoluble cationic fabric softener which is preferably a fatty acid ester of a mono- or polyhydric alcohol or an anhydride thereof and an aromatic mono- or dicarboxylic acid. Among the polyhydric alcohols that may be esterified, according to the patent, is pentaerythritol, but no pentaerythritol ester is described specifically, nor is any oligomer of pentaerythritol suggested and none is shown to be a useful fabric softening agent in the absence of quaternary ammonium salt and aromatic carboxylic acid. Although the patentees were aware of the disadvantages of the quaternary ammonium salt component (reaction with anionic detergent from the wash cycle) and found that its content could be reduced if the pentaerythritol ester and aromatic carboxylic acid were present, they never recognized and apparently never made a fabric softening composition which did not contain quaternary ammonium halide or equivalent cationic fabric softener.

U.S. Pat. No. 4,214,038 relates to polyglycerol esters as softening agents suitable for deposition on drying laundry from paper substrates charged to the laundry dryer with the laundry being dried. Although polyglycerol is a polyhydric alcohol, as is pentaerythritol, it is not the same as pentaerythritol, and the patent does not suggest the use of pentaerythritol esters as fabric softeners.

U.S. Pat. No. 5,126,060 describes a fabric softening composition based on the use of pentaerythritol esters as fabric softeners, which composition is essentially free of quat softeners. Anionic compositions, however, are not disclosed or exemplified. Although cationic and nonionic emulsifiers are disclosed, such as ethoxylated amines and ethoxylated alcohols, the use of applicant's specified anionic emulsifiers is neither disclosed nor exemplified.

European Patent Specification No. 276999-A mentions fabric conditioning compositions containing a non-cationic fabric softener and a nonionic cellulose ether. Although esters of polyhydric alcohols are mentioned as suitable conditioning agents, pentaerythritol esters are not disclosed therein.

German Patent Specification No. 3612479-A describes textile softening compositions containing quaternary ammonium compounds with carboxylic esters. Among the carboxylic acid esters mentioned are esters of various alcohols and polyols, including pentaerythritol. However, no such specific ester is described or even named and no softening composition which does not contain a quaternary ammonium compound as the fabric softener is disclosed.

Japanese Patent No. 90/47370 discloses fabric softening compositions based on quaternary ammonium salts which may contain higher fatty acid esters of pentaerythritol. No specific such ester is described in the abstract.

In none of the disclosures mentioned above it is taught that any pentaerythritol ester could be employed with a suitable anionic dispersing agent, optionally with a suitable nonionic emulsifier, as a fabric softener in place of a quat softener which would have advantageous softening action. Thus, none of the references, either alone or in combination with any of the others, anticipates the present invention or makes it obvious.

BRIEF SUMMARY OF THE INVENTION

The present invention provides a biodegradable fabric softening aqueous emulsion which comprises from about 1 to about 25 weight percent of a pentaerythritol fabric softener, from about 0.2 to about 10 weight percent of an anionic emulsifying agent selected from the group consisting of diisotridecyl sulfosuccinate (preferred), diisodecyl sulfosuccinate and the alkali metal salt of a fatty acid, from about 0 to about 10 weight percent of a nonionic ethoxylated alcohol, and from about 65 to about 99 weight percent of aqueous medium, wherein said emulsion is essentially free of quaternary ammonium fabric softener.

DETAILED DESCRIPTION OF THE INVENTION

The main component of the compositions of the present invention, which is essentially the only fabric softening compound in such products, other than bentonite, which may also be present in them, is preferably a higher fatty acid ester of a pentaerythritol compound, which term is used in this specification to describe higher fatty acid esters of pentaerythritol, higher fatty acid esters of pentaerythritol oligomers, higher fatty acid esters of lower alkylene oxide derivatives of pentaerythritol and higher fatty acid esters of lower alkylene oxide derivatives of pentaerythritol oligomers. Pentaerythritol compound may be abbreviated as PEC herein, which description and abbreviation may apply to any or all of pentaerythritol, oligomers thereof and alkyoxylated derivatives thereof, as such or as the esters, as will be indicated by the context.

The oligomers of pentaerythritol are preferably those of two to five pentaerythritol moieties, more preferably 2 or 3, with such moieties being joined together through single etheric bonds. The lower alkylene oxide derivatives thereof are preferably of ethylene oxide or propylene oxide monomers, dimers or polymers, which terminate in hydroxyls and are joined to the pentaerythritol or oligomer of pentaerythritol through etheric linkages. Preferably there will be one to ten alkylene oxide moieties in each such alkylene oxide chain, more preferably 2 to 6, and there will be one to ten such groups on a PEC, depending on the oligomer. At least one of the PEC OH groups and preferably at least two thereof will be esterified by a higher fatty acid or other higher aliphatic acid, which can be of an odd number of carbon atoms.

The higher fatty acid esters of the pentaerythritol compounds are preferably partial esters and more preferably there will be at least two free hydroxyls thereon after esterification (on the pentaerythritol, oligomer or alkoxyalkane). Usually the number of such free hydroxyls is two or about two but sometimes it may be one, as in pentaerythritol tristearate, or as many as eight, as in pentaerythritol tetrapalmitate.

The higher aliphatic or fatty acids that may be employed as esterifying acids are those of carbon atom contents in the range of 8 to 24, preferably 12 to 22 and more preferably 12 to 18, e.g., lauric, myristic, palmitic, oleic, stearic and behenic acids. Such may be mixtures of such fatty acids, obtained from natural sources, such as coco fatty acid, commercial stearic acid, tallow acid or hydrogenated tallow acid. Of the pure fatty acids lauric and stearic acids are often preferred, sometimes depending on the pentaerythritol moiety esterified. Intermediate synthetic acids of odd numbers of carbon atoms may also be employed.

Examples of some esters within the present invention follow:

MONOPENTAERYTHRITOL ESTERS

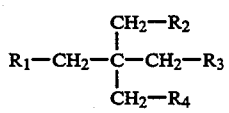

MONOPENTAERYTHRITOL DILAURATE $R_1=CH_3-(CH_2)_{10}-COO-$ $R_2=CH_3-(CH_2)_{10}-COO-$
$R_3=OH$ $R_4=OH$

MONOPENTAERYTHRITOL MONSTEARATE $R_1=CH_3-(CH_2)_{16}-COO-$ $R_2=OH$
$R_3=OH$ $R_4=OH$

DIPENTAERYTHRITOL ESTERS

-continued

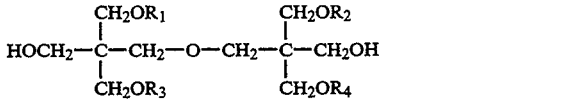

DIPENTAERYTHRITOL TETRALAURATE $R_1=CH_3-(CH_2)_{10}-CO$ $R_2=CH_3-(CH_2)_{10}-CO$
$R_3=CH_3-(CH_2)_{10}-CO$ $R_4=CH_3-(CH_2)_{10}-CO$

DIPENTAERYTHRITOL TETRASTEARATE $R_1=CH_3-(CH_2)_{16}-CO$ $R_2=CH_3-(CH_2)_{16}-CO$
$R_3=CH_3-(CH_2)_{16}-CO$ $R_4=CH_3-(CH_2)_{16}-CO$

MONOPENTAERYTHRITOL DISTEARATE $R_1=CH_3-(CH_2)_{16}-COO-$ $R_2=CH_3-(CH_2)_{16}-COO-$
$R_3=OH$ $R_4=OH$

MONOPENTAERYTHRITOL TRISTEARATE $R_1=CH_3-(CH_2)_{16}-COO-$ $R_2=CH_3-(CH_2)_{16}-COO-$
$R_3=CH_3-(CH_2)_{16}-COO-$ $R_4=OH$

MONOPENTAERYTHRITOL MONBEHENATE $R_1=CH_3-(CH_2)_{20}-COO-$ $R_2=OH$
$R_3=OH$ $R_4=OH$

MONOPENTAERYTHRITOL DIBEHENATE $R_1=CH_3-(CH_2)_{20}-COO-$ $R_2=CH_3-(CH_2)_{20}-COO-$
$R_3=OH$ $R_4=OH$

PENTAERYTHRITOL 10 ETHYLENE OXIDE ESTER

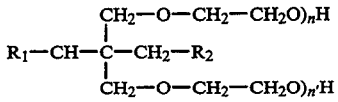

with $n + n' = 10$

MONOPENTAERYTHRITOL
10 ETHYLENE OXIDE DISTEARATE $R_1=CH_3-(CH_2)_{16}-COO-$ $R_2=CH_3-(CH_2)_{16}-COO-$

PENTAERYTHRITOL 4 PROPYLENE OXIDE ESTERS

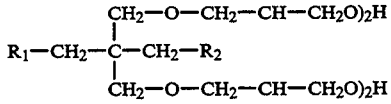

MONOPENTAERYTHRITOL
4 PROPYLENE OXIDE MONSTEARATE $R_1=CH_3-(CH_2)_{16}-COO-$ $R_2=OH$

MONOPENTAERYTHRITOL
4 PROPYLENE OXIDE DISTEARATE $R_1=CH_3-(CH_2)_{16}-COO-$ $R_2=CH_3-(CH_2)_{16}-COO-$

MONOPENTAERYTHRITOL
4 PROPYLENE OXIDE MONOBEHENATE $R_1=CH_3-(CH_2)_{20}-COO-$ $R_2=OH$

MONOPENTAERYTHRITOL
4 PROPYLENE OXIDE DIBEHENATE $R_1=CH_3-(CH_2)_{20}-COO-$ $R_2=CH_3-(CH_2)_{20}-COO-$

Although in the formulas given herein some preferred pentaerythritol compounds that are useful in the practice of this invention are illustrated it will be understood that various other such pentaerythritol compounds within the description thereof herein may be employed too, including such as pentaerythritol dihydrogenated tallowate, pentaerythritol ditallowate, pentaerythritol dipalmitate, and dipentaerythritol tetratallowate. Also, in this specification when reference is to a compound of a class, unless it is indicated otherwise therein it is to be considered that the employment of mixtures of compounds of such class are intended to be included (commercial compounds are often mixtures).

The emulsions (which term herein is also intended to refer to dispersions and suspensions in liquid media, as well as to microemulsions [and sometimes solutions may be present, too]) of this invention will normally be aqueous emulsions in which the aqueous phase is the continuous phase, with the pentaerythritol compound being in the dispersed phase. However, solvents and cosolvents, such as ethanol, isopropanol, propylene glycol and various mono- and di-lower alkyl esters of diethylene glycol (Carbitols ®) may also be present to promote formations of stable products, when such is desirable.

The anionic emulsifiers which can be employed in the compositions of the present invention are diisotridecyl sulfosuccinate (preferred), diisodecyl sulfosuccinate and an alkali metal, preferably sodium, salt of a fatty acid, preferably a $C_{12}$–$C_{18}$ fatty acid such as, for example, sodium laurate ($C_{12}$), sodium myristate ($C_{14}$), sodium palmitate ($C_{16}$) and sodium stearate ($C_{18}$).

The optional nonionic emulsifiers of the present invention are higher alkyl ethers which contain one or more hydroxyalkyl substituents. Of these the more preferred are the higher alkyl lower di- or polyethylene glycol ethers of 2.5 to 12 ethoxy groups (4 to 24 carbon atoms), preferably the higher alkyl diethylene glycol ethers, in which the higher alkyl is of 8 to 24, preferably 12 to 18 carbon atoms. Such ethers are known as ethoxylated alcohols and can be symbolized as, for example, $C_{14}$–$C_{15}E_9$ wherein C with is numerical subscript represents the average carbon atom content of the alcohol function and E with its numerical subscript represents the number of ethoxy functions in the resultant ether. Among the preferred ethoxylated alcohols are those identified by the following symbols:

$C_9$–$C_{11}E_{2.5}=[C_{9-C11}]-(OCH_2CH_2)_{2.5}-OH$
$C_9$–$C_{11}E_5=[C_{9-C11}]-(OCH_2CH_2)_5-OH$
$C_9$–$C_{11}E_6=[C_{9-C11}]-(OCH_2CH_2)_6-OH$
$C_9$–$C_{11}E_8=[C_{9-C11}]-(OCH_2CH_2)_8-OH$
$C_9$–$C_{11}E_6+C_9-C_{11}E_8$
$C_{13}$–$C_{15}E_9=[C_{13}-C_{15}]-(OCH_2CH_2)_9-OH$
$C_{13}$–$C_{15}E_{11}=[C_{13}-C_{15}]-(OCH_2CH_2)_{11}-OH$
$C_{16}$–$C_{18}E_9=[C_{16}-C_{18}]-(OCH_2CH_2)_9-OH$
$C_{16}$–$C_{18}E_{12}=[C_{16}-C_{18}]-(OCH_2CH_2)_{12}-OH$
$C_{16}$–$C_{18}E_9+C_{16}-C_{18}E_{12}$
$C_{16}$–$C_{18}E_{11}=[C_{16}-C_{18}]-(OCH_2CH_2)_{11}-OH$

The foregoing ethoxylated alcohols are supplied under the tradename "Dobanol" by Shell Chemicals (Amsterdam-The Netherlands); under the tradename "Synperonic" by ICI Surfactants (Cleveland-U.K.); and by Condes Chemie (Brunsbuettel-Germany).

Normally, the PEC will be employed without the presence of any other fabric softening material but it is possible to utilize such other materials with it if they are not ecologically unacceptable and if they do not interfere with the softening action of the PEC. In fact, sometimes, when antistatic action is desirable in the product, such additions may be important because although PEC's have some antistatic properties sometimes they are not sufficient for the intended purposes. Thus, it is possible to formulate fabric softening compositions with the PEC supplemented by other fabric softeners and antistatic agents. However, for purposes of this invention, use of antistatic quats are to be avoided, not only because when they are present there can be ecological problems, due to their toxicities to aquatic organisms, but because their cationic character is contra of the anionic character of the invented compositions. It should be kept in mind, therefore, when employing supplementary fabric softeners and antistats, that they should not change the anionic nature of the composition and they should not make the composition in which they are incorporated of greater ecotoxicity than is allowed by regulatory authorities in the area of intended use.

Other materials that may be incorporated in the invented compositions include the usual adjuvants that normally are present in other fabric softening compositions, such as perfumes, fixatives, solvents, cosolvents, hydrotropes, antioxidants, stabilizers, biodegradable antimicrobials, fillers, thickeners and fluorescent brighteners, all of which are known classes of materials in the fabric softening compositions field, with examples of several of these being given in the art mentioned in this specification, all of which is hereby incorporated herein by reference.

The last component of the present compositions, which is required in the aqueous emulsions, is water. Normally, any clean water can be employed, such as any of a hardness in the range of 0 to 500 p.p.m., as $CaC_3$, but it will be preferred to use water of a hardness of no more than 150 p.p.m., more preferably less than 50 p.p.m., and most preferably the water will be deionized water that has been irradiated.

The proportions of components of the invented compositions will be chose which result in stable and effective products for fabric softening applications. For the PEC's the concentration by weight in such compositions will normally be in the range of about 1 to 25%, and preferably about 3 to 7%, e.g., about 5%. For the emulsions the content of anionic emulsifier(s) will normally be in the range of about 0.2 to 10%, preferably about 1 to 3%. The content of the optional nonionic ethoxylated alcohol(s) will be in the range of 0 to 10%, preferably 0 to 0.25%.

The aqueous medium or water content of these compositions is the balance thereof, usually being in the range of about 65 to 99%, preferably about 90 to 95%, e.g., about 93.75%. It is to be understood that the presence of any adjuvants or supplemental components of the emulsions will be compensated for by corresponding decreases in the water contents of the compositions. Usually the total adjuvants content will be nor more than 25%, preferably will be no more than 15% and in many instances will be held to a limit of 5%. None of the adjuvants employed will be such as to cause unacceptable levels of toxicity which could adversely affect aquatic organisms, including fish that inhabit lakes and streams into which there are fed washing machine rinses that had been charged with the present compositions.

To manufacture the invented compositions is comparatively simple but to produce applicant's desired stable emulsions (and microemulsions) a particular process is desirably followed. To produce the desired stable emulsions it is preferable that the PEC and the anionic emulsifier be mixed together and melted before addition to the aqueous medium. Alternatively, the two meltable materials, PEC and anionic emulsifier, may be separately melted and added together or simultaneously to the aqueous medium (usually water), which should also be at about the same elevated temperature, about 60° C., for example.

When the emulsion is based on the use of diisotridecyl sulfosuccinate as the anionic emulsifier, the water employed is desirably acidified, as by addition to it of HCl or other suitable acid, until the pH thereof is in the range of 2 to 7, preferably 2.5 to 5.5, e.g., about 3.5.

When the emulsion is based on the use of a fatty acid salt as the anionic emulsifier, it is preferably generated in situ by neutralizing the corresponding fatty acid which is introduced together with the PEC. The water employed desirably contains an amount of NaOH or other suitable base sufficient to neutralize the fatty acid content in the emulsion produced by the fatty acid salt.

After the mixing, the emulsion produced may be cooled to room temperature, with the nonionic ethoxylated alcohol emulsifier being added before or after such cooling, preferably before. For purposes of homogeneity, it is preferred that the nonionic emulsifier, if not already in a liquid state, be heated to a liquid or molten state prior to its addition to the warm emulsion. The result is a stable emulsion, which resists separation after a test period of three months at room temperature (about 18°–25° C.), although some coacervation is observed in the composition containing sodium laurate as the sole anionic emulsifier.

In use, the various invented compositions are employed in the same manners as other emulsions that apply fabric softener to laundry. The emulsion may be added to rinse water, with the concentrations of PEC being in the range of about 0.01 to 0.05% of the rinse water. Alternatively, such compositions may be added to the wash water but in such cases the concentrations may be increased, often about 1 to 3 times.

The following examples illustrate but do not limit the invention. Unless otherwise indicated all parts and percentages in this specification and the appended claims are by weight and all temperatures are in ° C.

EXAMPLE 1

| Component | Weight Percent |
|---|---|
| Pentaerythritol ditallowate | 4.9 |
| Diisotridecyl sulfosuccinate | 1.0 |
| $C_{16}$–$C_{18}$ $E_9$ | 0.25 |
| Hydrochloric acid (concentrated) | 0.1 |
| Water, deionized, q.s. ad 100% | |

A stable emulsion is made of the above formula by heating together the pentaerythritol ditallowate and the diisotridecyl sulfosuccinate to 60° C. and then admixing such melted mixture with the 60° C. acidified water after which the nonionic component, $C_{16}$–$C_{18}$ $E_9$, also at 60° C., is admixed with the water emulsion of pentaerythritol ditallowate and diisotridecyl sulfosuccinate. The resulting stable anionic emulsion, which is at a pH of about 3.5, is a good fabric softening composition.

In a variation of the formula of this Example, instead of pentaerythritol ditallowate, other relatively effective PEC's include pentaerythritol dilaurate, pentaerythritol distearate and pentaerythritol di-hydrogenated tallowate.

Diisodecyl sulfosuccinate may be utilized as the anionic component in the above formulation but with lesser fabric softening efficacy.

EXAMPLE 2

| Component | Weight Percent |
|---|---|
| Pentaerythritol ditallowate | 5.2 |
| Sodium myristate | 1.1 |
| $C_{16}$–$C_{18}$ $E_5$ + $C_{16}$–$C_{18}$ $E_7$, ratio 1:1.6 | 1.4 |
| Sodium hydroxide 1M | 4.3 |
| Water, deionized, q.s. ad 100% | |

A stable emulsion is made of the above formula by heating together the pentaerythritol ditallowate and the sodium myristate to 60° C. and then admixing such melted mixture with the 60° C. basified water after which the nonionic component, also at 60° C., is admixed with the water emulsion of pentaerythritol ditallowate and sodium myristate. The resulting anionic emulsion is not only a good fabric softening composition, but the use of a fatty acid soap such as sodium myristate, and, alternatively, sodium laurate, sodium palmitate, sodium stearate and the like, is relatively inexpensive and the soap itself imparts some softness to the composition.

The invention has been described with respect to various working examples and embodiments thereof but it is not to be considered to be limited to those because one of skill-in-the-art, with the present specification before him or her, will be able to utilized substitutes and equivalents without departing from the invention.

EXAMPLE 3

| Component | Weight Percent | | |
|---|---|---|---|
| | A | B | C |
| Pentaerythritol ditallowate | 4.9 | 4.9 | 4.9 |
| Diisotridecyl sulfosuccinate | 1.0 | 1.0 | 0.0 |
| $C_{13}$–$C_{15}$ $E_9$ | 0.0 | 0.25 | 0.25 |
| Odorant | 0.32 | 0.32 | 0.32 |
| Hydrochloric acid (conc.) | 0.1 | 0.1 | 0.1 |
| Deionized water, q.s. ad 100% | | | |

A stable emulsion is made of each formulation by preparing a molten mixture of the first three or four components, as the case may be, which is then poured into the warmed deionized water (60° C.) with stirring, to which is then added the hydrochloric acid.

Experimental results observed on the fabric softening efficacy of each emulsion formulation on similarly treated fabrics indicates that removal of the nonionic component from the composition (A versus B) significantly improves its softening performance. Conversely, in the presence of the nonionic, the softening performance is not significantly modified by the removal of the anionic component (B versus C).

Experimental conditions: lab minisoftening machine with desized terry towels; 4.4 g/L in tap water; swatches dried and conditioned at 21° C., 50% RH; pair comparison.

EXAMPLE 4

| Component | Weight Percent | | |
|---|---|---|---|
| | A | B | C |
| Pentaerythritol ditallowate | 5.2 | 5.2 | 5.2 |
| Sodium myristate* | 1.1 | 1.1 | 0.0 |
| $C_{16}$–$C_{18}$ $E_5$ + $C_{16}$–$C_{18}$ $E_7$, ratio 1:1.6 | 0.0 | 1.4 | 1.4 |
| Deionized water, q.s. ad 100% | | | |

*Molten mixture of ditallowate and myristic acid are added in warm deionized water (60° C.) containing NaOH to provide the indicated amount of sodium myristate: 1% myristic acid; 4.4% NaOH solution (40 g/L).

A stable emulsion of each of the above formulations is made and then experimentally tested for fabric softening efficacy as in Example 3 with similar results.

What is claimed is:

1. A fabric softening aqueous emulsion which comprises by weight from about 1 to about 25% of a higher aliphatic acid ester of pentaerythritol, of an oligomer of pentaerythritol, of a lower alkylene oxide derivative of pentaerythritol or of a lower alkylene oxide derivative of an oligomer of pentaerythritol, or a mixture of any two or more thereof, from about 0.2 to about 10% of an anionic emulsifying agent selected from the group consisting of diisotridecyl sulfosuccinate, diisodecyl sulfosuccinate, and the alkali metal salt of a fatty acid, from about 0 to about 10% of an ethoxylated alcohol emulsifier, and from about 65 to about 99% of aqueous medium, wherein said emulsion is essentially free of cationic emulsifiers and fabric softeners.

2. A fabric softening emulsion according to claim 1 wherein said pentaerythritol ester is pentaerythritol ditallowate, pentaerythritol dilaurate, pentaerythritol distearate or pentaerythritol di-hydrogenated tallowate.

3. A fabric softening emulsion according to claim 1 wherein said pentaerythritol ester is pentaerythritol ditallowate.

4. A fabric softening emulsion according to claim 1 wherein said anionic emulsifying agent is diisotridecyl sulfosuccinate or sodium myristate.

5. A fabric softening emulsion according to claim 1 wherein said pentaerythritol ester is pentaerythritol ditallowate and said anionic emulsifying agent is diisotridecyl sulfosuccinate or sodium myristate.

6. A fabric softening emulsion according to claim 1 wherein the amount of said pentaerythritol ester is from about 3 to about 7 percent.

7. A fabric softening emulsion according to claim 1 where the amount of said anionic emulsifying agent is from about 1 to about 3%.

8. A fabric softening emulsion according to claim 1 where the amount of said ethoxylated alcohol emulsifier is from about 0 to 0.25%.

* * * * *